US009953484B2

(12) United States Patent
Bolling, Jr. et al.

(10) Patent No.: US 9,953,484 B2
(45) Date of Patent: Apr. 24, 2018

(54) METHOD OF GAMING, A GAMING SYSTEM AND A GAME CONTROLLER

(71) Applicant: Aristocrat Technologies Australia Pty Limited, North Ryde, NSW (AU)

(72) Inventors: T. Grant Bolling, Jr., Maryland Heights, MO (US); Kurt Larsen, Las Vegas, NV (US); Amanda Flock, Las Vegas, NV (US); Clint Batac, Las Vegas, NV (US); Cash Imutan, Henderson, NV (US); C'era Oliveira, Honolulu, HI (US); Joe Masinter, Las Vegas, NV (US)

(73) Assignee: ARISTOCRAT TECHNOLOGIES AUSTRALIA PTY LIMITED, North Ryde, NSW (AU)

( * ) Notice: Subject to any disclaimer, the term of this patent is extended or adjusted under 35 U.S.C. 154(b) by 0 days.

(21) Appl. No.: 15/263,920

(22) Filed: Sep. 13, 2016

(65) Prior Publication Data

US 2016/0379437 A1 Dec. 29, 2016

Related U.S. Application Data

(63) Continuation-in-part of application No. 14/864,522, filed on Sep. 24, 2015.

(30) Foreign Application Priority Data

Sep. 26, 2014 (AU) ..... 2014903842

(51) Int. Cl.
*G07F 17/34* (2006.01)
*G07F 17/32* (2006.01)

(52) U.S. Cl.
CPC ..... *G07F 17/3213* (2013.01); *G07F 17/326* (2013.01); *G07F 17/3209* (2013.01);
(Continued)

(58) Field of Classification Search
CPC ..... G07F 17/32; G07F 17/326; G07F 17/3213
(Continued)

(56) References Cited

U.S. PATENT DOCUMENTS

2013/0190065 A1* 7/2013 Saunders ..... G07F 17/3213 463/20
2014/0146324 A1* 5/2014 Lim ..... G01B 9/02038 356/497
2014/0162749 A1* 6/2014 Ryan ..... G07F 17/3244 463/20

* cited by examiner

*Primary Examiner* — Omkar Deodhar
*Assistant Examiner* — Shauna-Kay Hall
(74) *Attorney, Agent, or Firm* — McAndrews, Held & Malloy, Ltd.

(57) ABSTRACT

An electronic method of gaming includes displaying an evaluation area having columns of symbol display positions divided between first and second game instances by a border such that positions on a first side of the border are allocated to the first game instance and positions on a second side of the border are allocated to the second game instance. The method includes selecting symbols for the first and second game instances and displaying the selected symbols in response to initiation of a round of gaming. The method includes determining a winning game instance associated with the round. The winning instance is determined based on a round number and a position of the border divider. The method includes moving the border divider based on the determination of the winning game instance. The method includes determining an award based on symbols displayed at the symbol positions after the border divider is moved.

20 Claims, 11 Drawing Sheets

(52) U.S. Cl.
CPC ..... *G07F 17/3225* (2013.01); *G07F 17/3246* (2013.01); *G07F 17/3251* (2013.01); *G07F 17/3262* (2013.01); *G07F 17/34* (2013.01)

(58) Field of Classification Search
USPC ..... 463/20
See application file for complete search history.

| | Spin 1 | | Spin 2 | | Spin 3 | | Spin 4 | | Spin 5 | |
|---|---|---|---|---|---|---|---|---|---|---|
| | Wt Up | Wt Down | Wt Up | Wt Down | Wt Up | Wt Down | Wt Up | Wt Down | Wt Up | Wt Down |
| 0 | | | | | | | | | | |
| 1 | | | | | | | 0 | 1 | | |
| 2 | | | | | 1 | 3 | | | 3 | 1 |
| 3 | | | 1 | 2 | | | 5 | 3 | | |
| 4 | 1 | 1 | | | 1 | 1 | | | 1 | 1 |
| 5 | | | 2 | 1 | | | 3 | 5 | | |
| 6 | | | | | 3 | 1 | | | 1 | 3 |
| 7 | | | | | | | 1 | 0 | | |
| 8 | | | | | | | | | | |

| | Spin 6 | | Spin 7 | | Spin 8 | | Spin 9 | | Spin 10 | |
|---|---|---|---|---|---|---|---|---|---|---|
| | Wt Up | Wt Down | Wt Up | Wt Down | Wt Up | Wt Down | Wt Up | Wt Down | Wt Up | Wt Down |
| 0 | | | | | | | | | | |
| 1 | 1 | 2 | | | 3 | 1 | | | 7 | 1 |
| 2 | | | 3 | 1 | | | 3 | 1 | | |
| 3 | 1 | 1 | | | 5 | 3 | | | 5 | 3 |
| 4 | | | 1 | 1 | | | 1 | 1 | | |
| 5 | 1 | 1 | | | 3 | 5 | | | 3 | 5 |
| 6 | | | 1 | 3 | | | 1 | 3 | | |
| 7 | 2 | 1 | | | 1 | 3 | | | 1 | 7 |
| 8 | | | | | | | | | | |

| | Spin 11 | | Spin 12 | | Spin 13 | | Spin 14 | | Spin 15 | |
|---|---|---|---|---|---|---|---|---|---|---|
| | Wt Up | Wt Down | Wt Up | Wt Down | Wt Up | Wt Down | Wt Up | Wt Down | Wt Up | Wt Down |
| 0 | | | | | | | | | | |
| 1 | | | 7 | 1 | | | 7 | 1 | | |
| 2 | 3 | 1 | | | 3 | 1 | | | 3 | 1 |
| 3 | | | 5 | 3 | | | 5 | 3 | | |
| 4 | 1 | 1 | | | 1 | 1 | | | 1 | 1 |
| 5 | | | 3 | 5 | | | 3 | 5 | | |
| 6 | 1 | 3 | | | 1 | 3 | | | 1 | 3 |
| 7 | | | 1 | 7 | | | 1 | 7 | | |
| 8 | | | | | | | | | | |

| | Spin 16 | | Spin 17 | | Spin 18 | | Spin 19 | | Spin 20 | |
|---|---|---|---|---|---|---|---|---|---|---|
| | Wt Up | Wt Down | Wt Up | Wt Down | Wt Up | Wt Down | Wt Up | Wt Down | Wt Up | Wt Down |
| 0 | | | | | | | | | | |
| 1 | 7 | 1 | | | 7 | 1 | | | 1 | 0 |
| 2 | | | 3 | 1 | | | 1 | 0 | | |
| 3 | 5 | 3 | | | 1 | 0 | | | | |
| 4 | | | 1 | 1 | | | | | | |
| 5 | 3 | 5 | | | 0 | 1 | | | | |
| 6 | | | 1 | 3 | | | 0 | 1 | | |
| 7 | 1 | 7 | | | 1 | 7 | | | 0 | 1 |
| 8 | | | | | | | | | | |

FIG. 11

METHOD OF GAMING, A GAMING SYSTEM AND A GAME CONTROLLER

RELATED APPLICATIONS

The present application is a continuation-in-part of U.S. patent application Ser. No. 14/864,522, filed Sep. 24, 2015, which claims priority to Australian Provisional Patent Application No. 2014903842 having an International filing date of Sep. 26, 2014. The above-identified applications are hereby incorporated herein by reference in their entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

In electronic gaming systems such as spinning reel or "slot" gaming machines, symbols are selected for display on a display of the machine. The displayed symbols are evaluated to determine whether an award is to be made to a player.

While such gaming systems provide players with enjoyment, a need exists for new gaming systems in order to maintain or increase player enjoyment.

BRIEF SUMMARY OF THE INVENTION

A system and/or method is provided for a spinning reel game having a border divider separating two game instances each corresponding with one character, the border divider moveable after each reel spin during a game based on a weighted table until all reels are controlled by one character, wherein an award is provided after each reel spin that corresponds with a number of displayed character or award symbols, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

BRIEF DESCRIPTION OF SEVERAL VIEWS OF THE DRAWINGS

Embodiments of the invention will now be described with reference to the accompanying drawings in which:

FIG. 11 is an example of a weighted table in accordance with an embodiment of the invention.

DETAILED DESCRIPTION OF THE INVENTION

Figure 1:
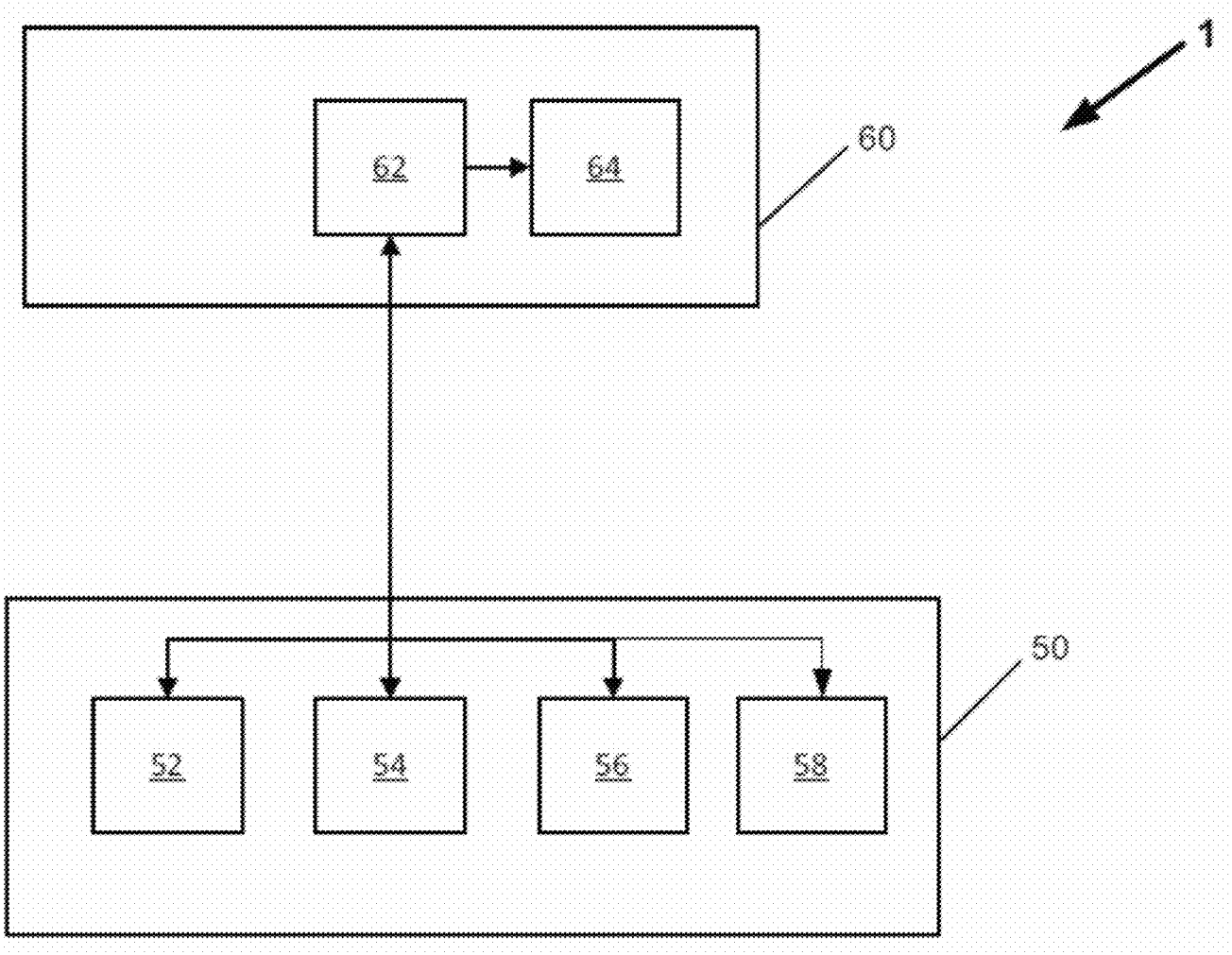
FIG. 1 is a block diagram of the core components of a gaming system.

Referring to the drawings, there is shown an embodiment of an electronic gaming system having an electronic game controller arranged to operate the gaming system to implement a game where first and second separate game instances are conducted concurrently in a symbol evaluation area that is divided between the game instances such that symbol display positions of the evaluation area are allocated to either a first game along a moveable border divider between the two game instances. The gaming system is configured to display first character symbols and non-character symbols at symbol display positions within the first game instance. The gaming system is configured to display second character symbols and non-character symbols at symbol display positions within the second game instance. In an embodiment, the first character symbols and/or non-character symbols are visually distinguishable from the second character symbols and/or non-character symbols. In an embodiment, the character symbols (also referred to as award symbols) may not include a character and/or the non-character symbols (also referred to as non-award symbols) may include a character. In an embodiment, the character symbols are visually distinguishable from the non-character symbols. For example, the character symbols and non-character symbols may be different colors, characters, letters, numbers, symbols, and/or include any suitable distinguishing feature.

In response to a determination of a winning character (e.g., the first character associated with the first game instance or the second character associated with the second game instance), the border divider between the two game instances is moved and the visual appearance of display positions that have changed control based on the movement of the border divider are updated. In an embodiment, one of the game instances gains either a row or a column of symbol display positions while the other of the game instances loses the same row or column of symbol display positions. In an embodiment, the determination of the winning character is a semi-random method based at least in part on how many spins have occurred during the game and the number or reels each character controls. In an embodiment, an award may be provided based at least in part on a total number of character/award symbols displayed in the first game instance and the second game instance.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system 1 has several core components. At the broadest level, the core components are a player interface 50 and a game controller 60 as illustrated in FIG. 1. The player interface 50 is arranged to enable manual interaction between a player and the gaming system 1 and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface 50 and typically includes a processor 62 that processes the game play instructions in accordance with game play rules and outputs game play outcomes to the display(s) 54. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
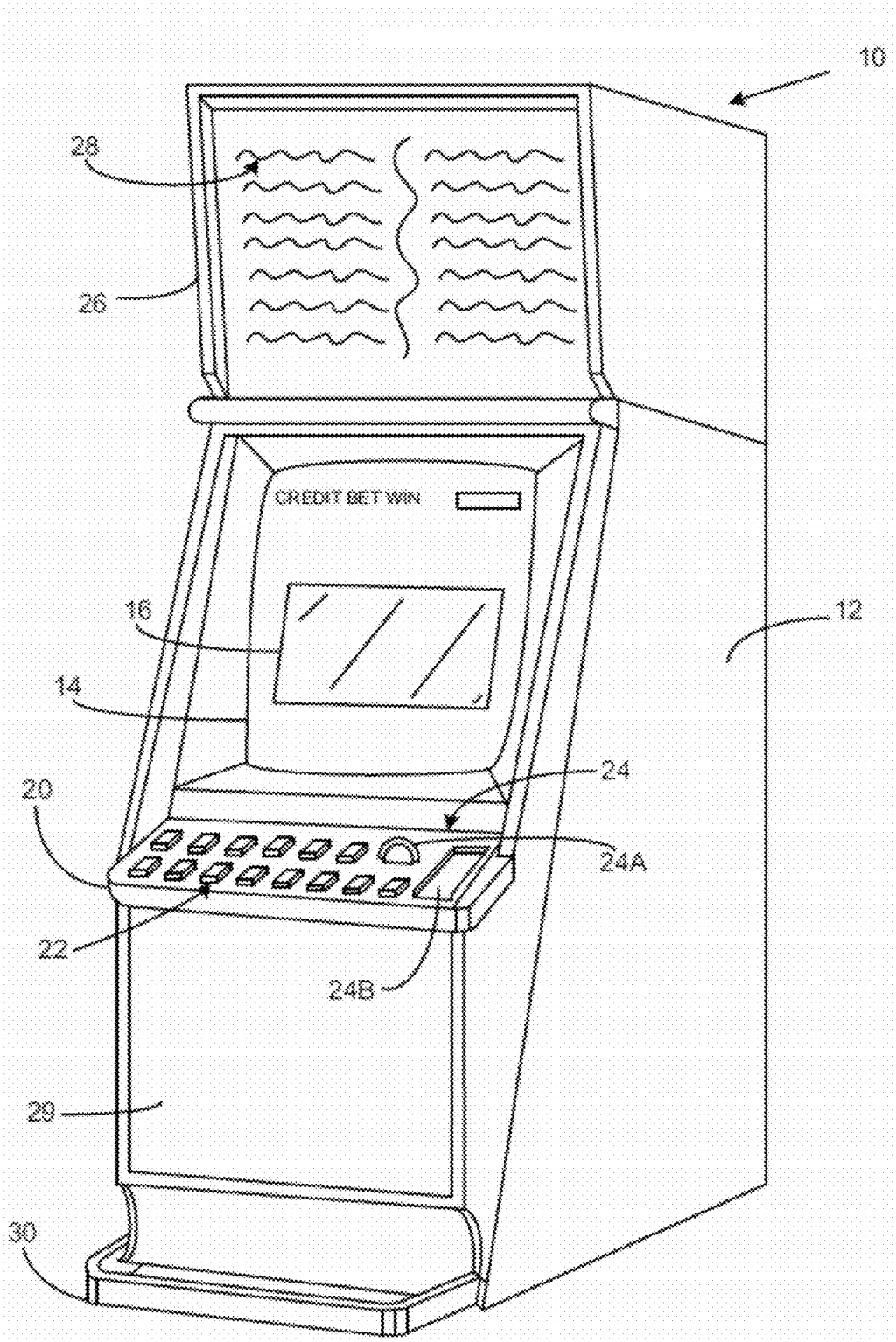
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may be configured to accept a ticket such that they have a ticket reader for reading tickets having a value and crediting the player based on the face value of the ticket. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a liquid crystal display. Alternatively, the display 14 may be a light emitting diode display, plasma screen, and/or any other suitable video display unit. The top box 26 may also include a display, for example a video display unit, which may be of the same type as the display 14, or of a different type.

Figure 3:
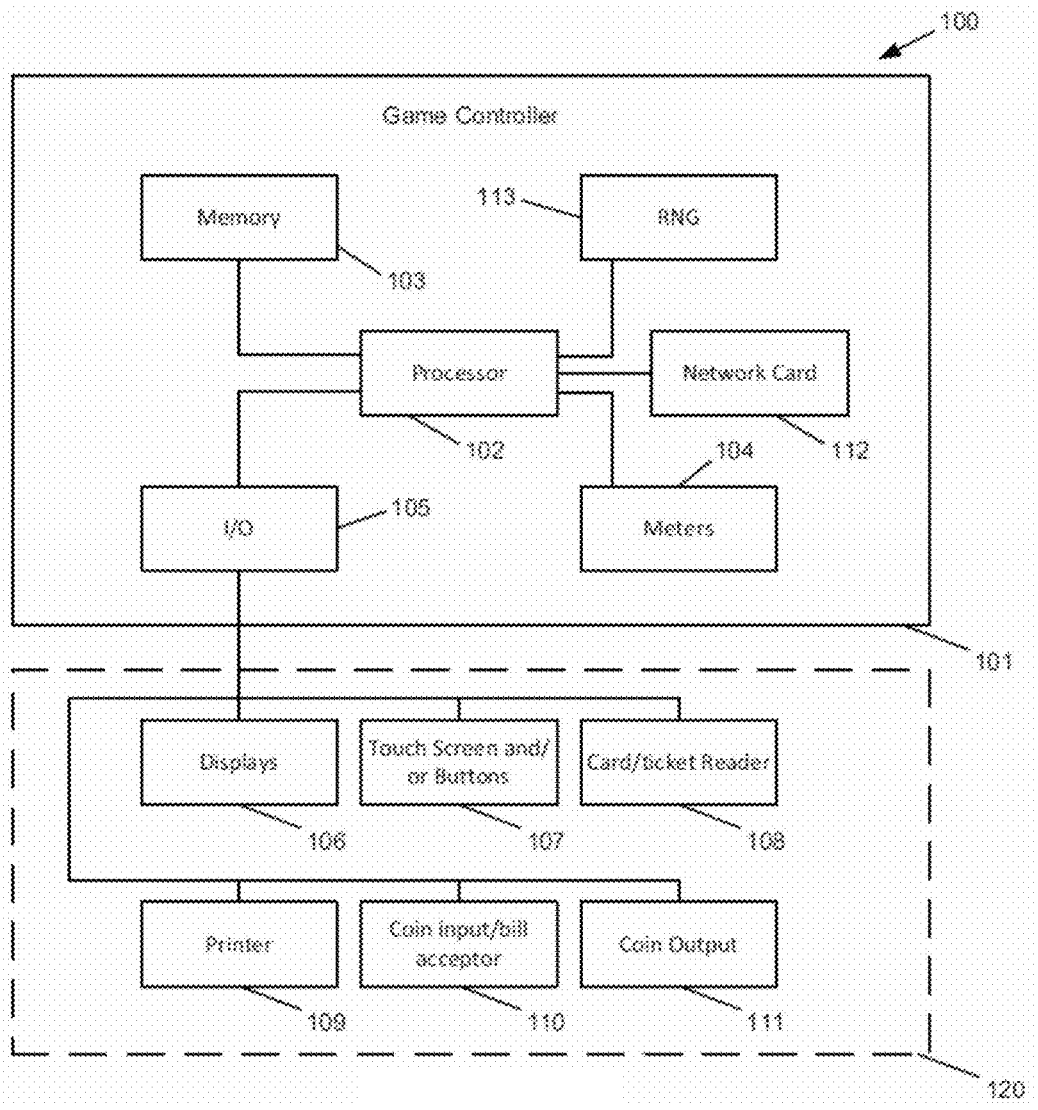
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game, any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
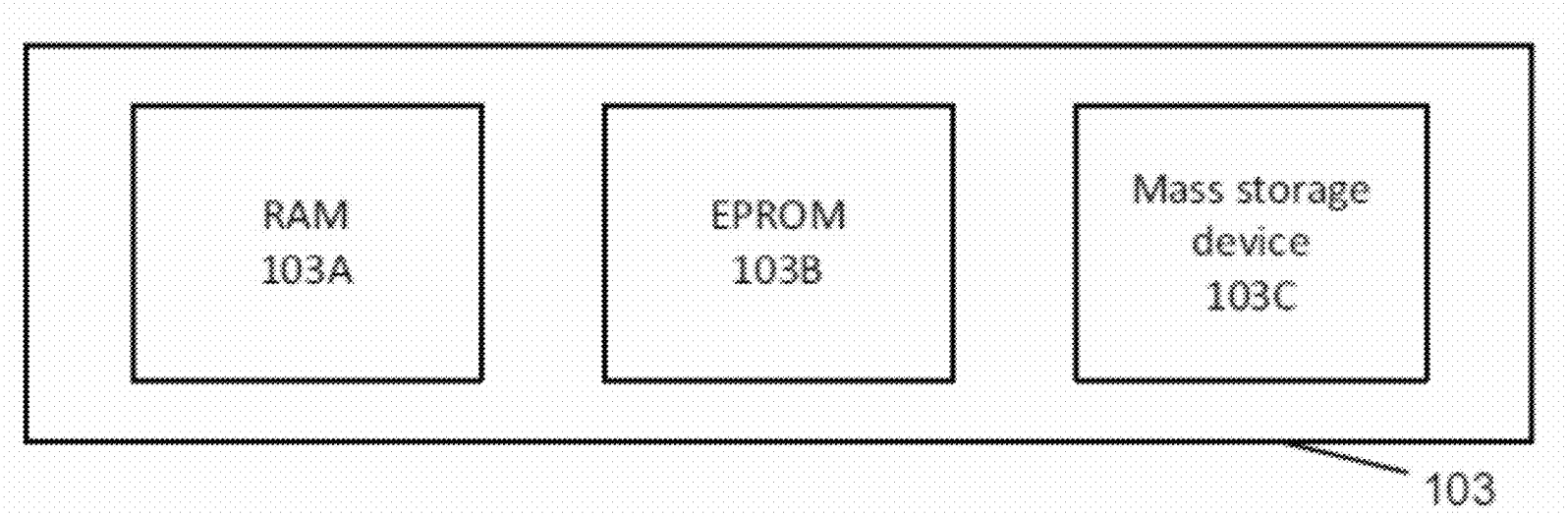
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106, 107, 108, 109, 110, 111 to be provided remotely from the game controller 101.

Figure 5:
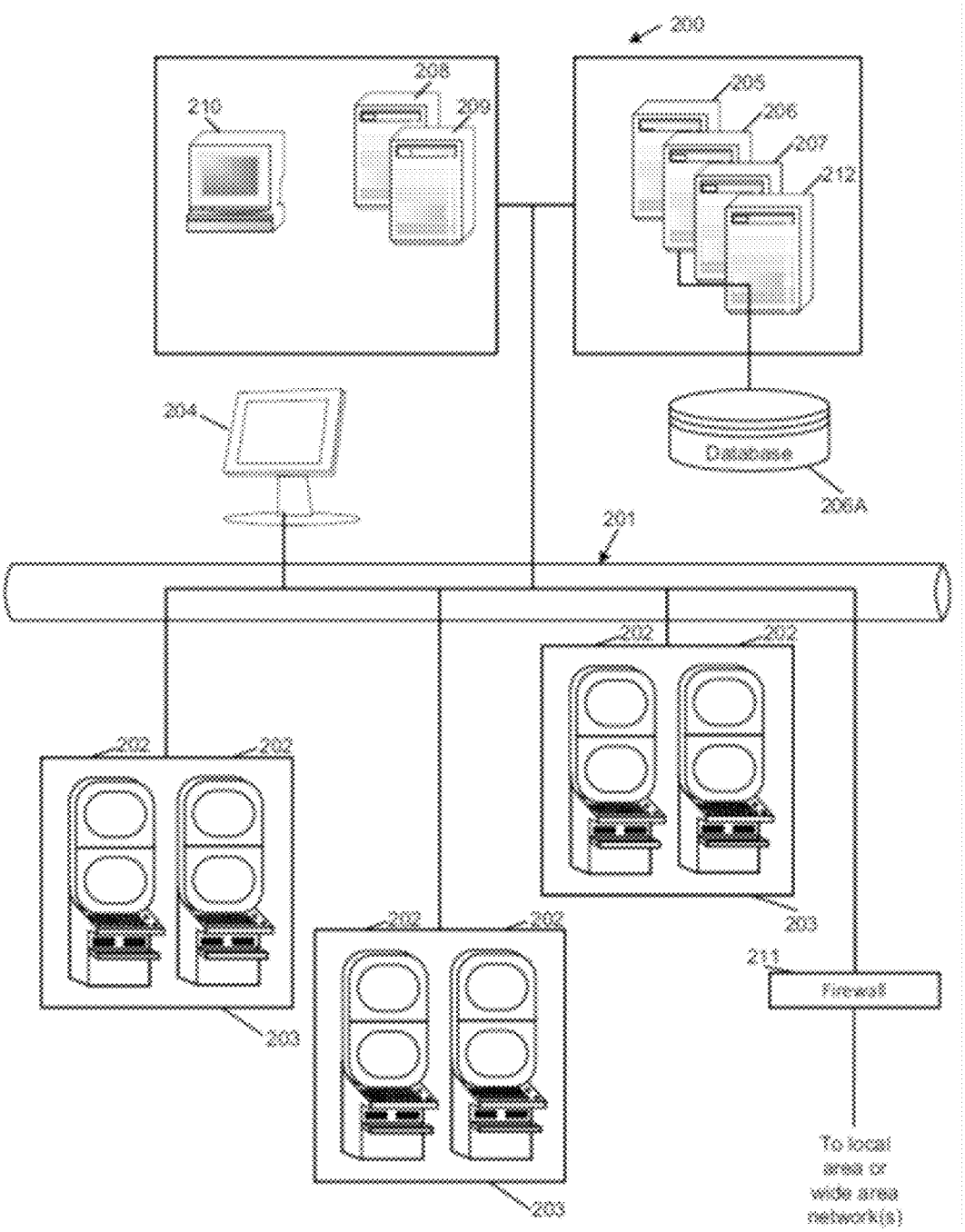
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5 are connected to the network 201. The gaming machines 202 provide a player operable interface and may be the same as the gaming machines 10, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

Figure 9:
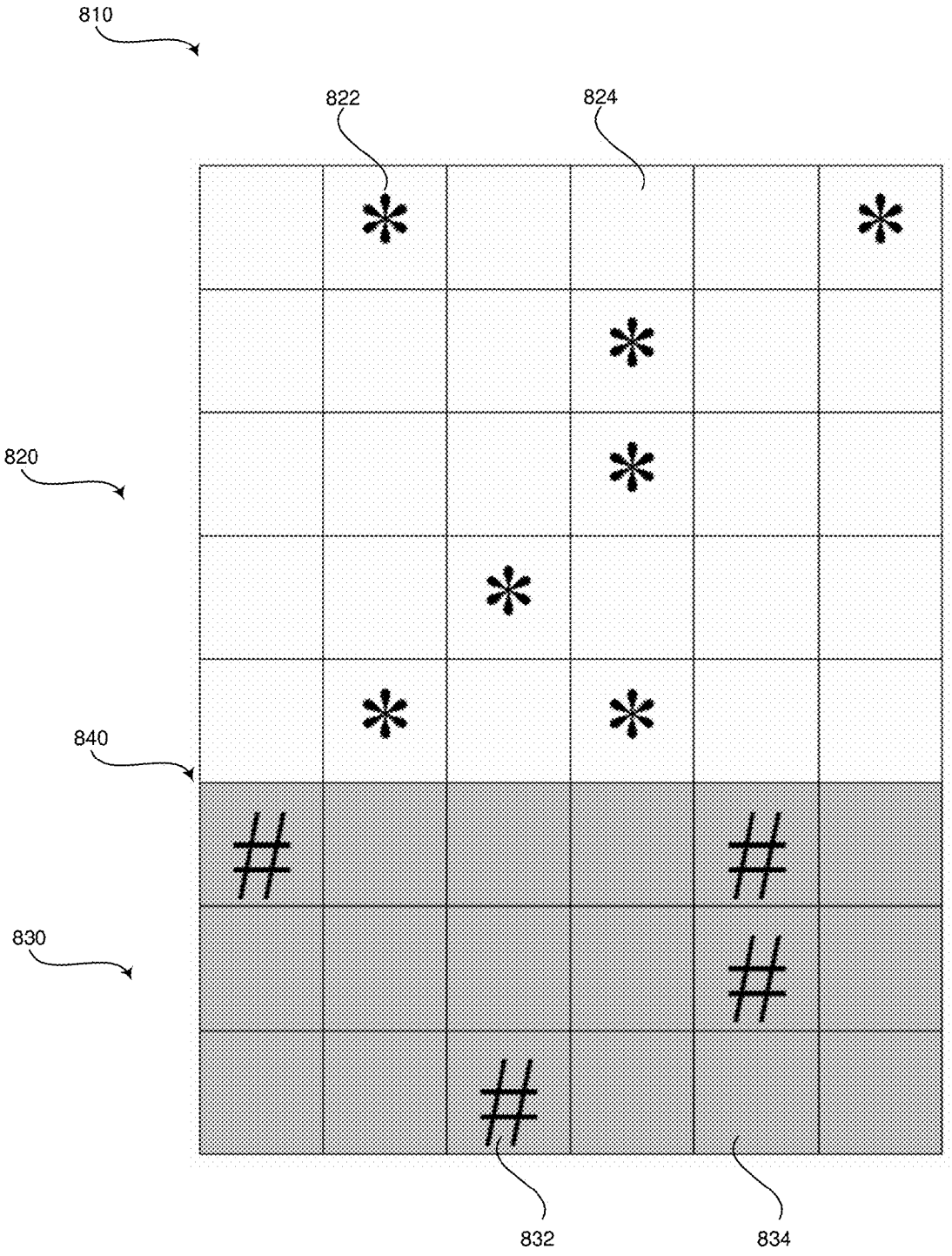
FIG. 9 shows an example of moving a border divider and updating display position appearance, from the border divider position and display position appearance illustrated in FIG. 8, based on a determined winning character.
Figure 10:
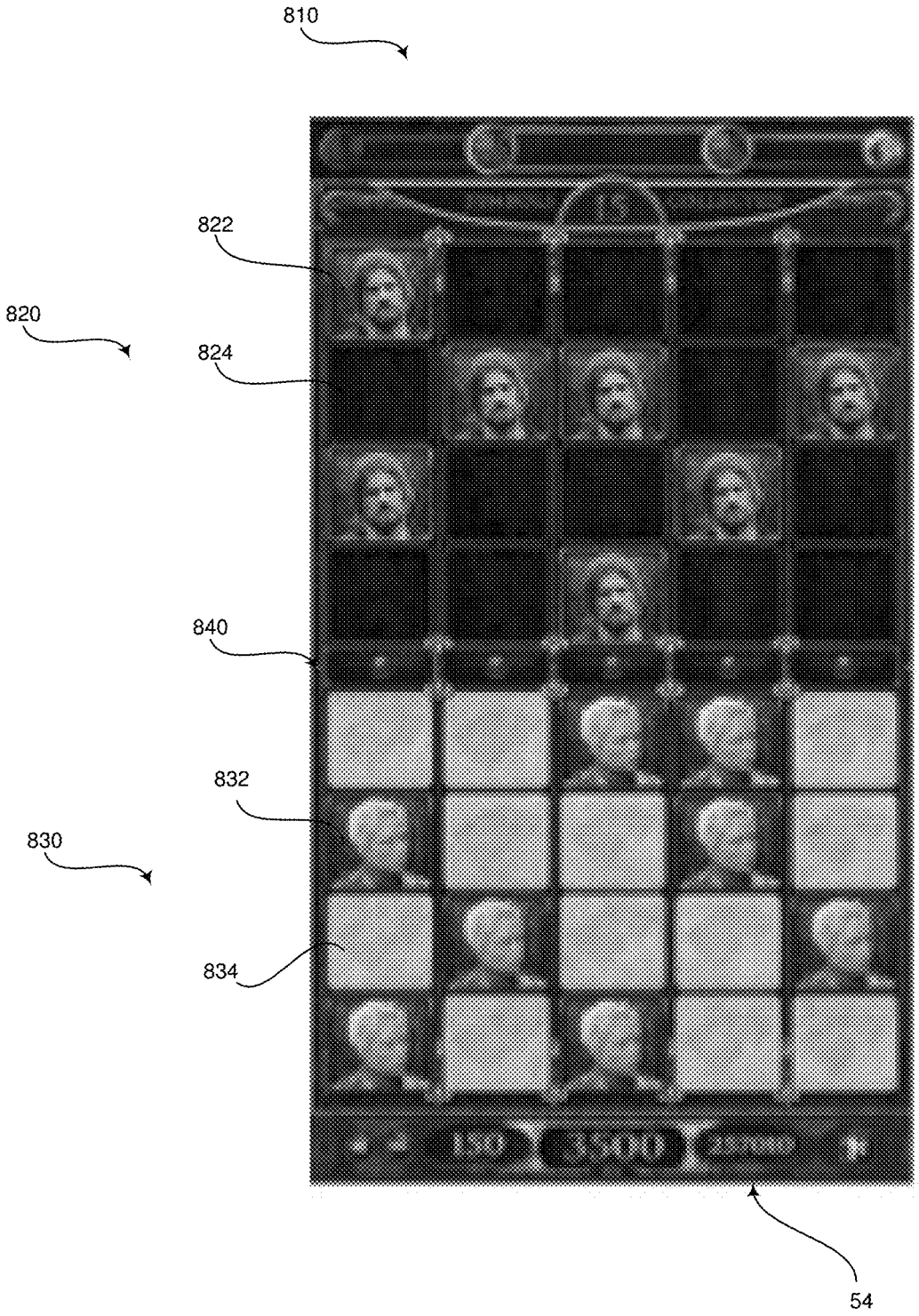
FIG. 10 is a screen shot of an example of a display of a spinning reel game having a border divider separating two game instances each corresponding with one character.

The player operates the game play mechanism 56 to specify a wager for the game and to initiate a play of the game. In the embodiment, at least certain of the wagers that the player can wager entitles the player to two separate game instances 820, 830 being carried out in a symbol evaluation area 810 as shown in FIGS. 8, 9, and 10.

Figure 6:
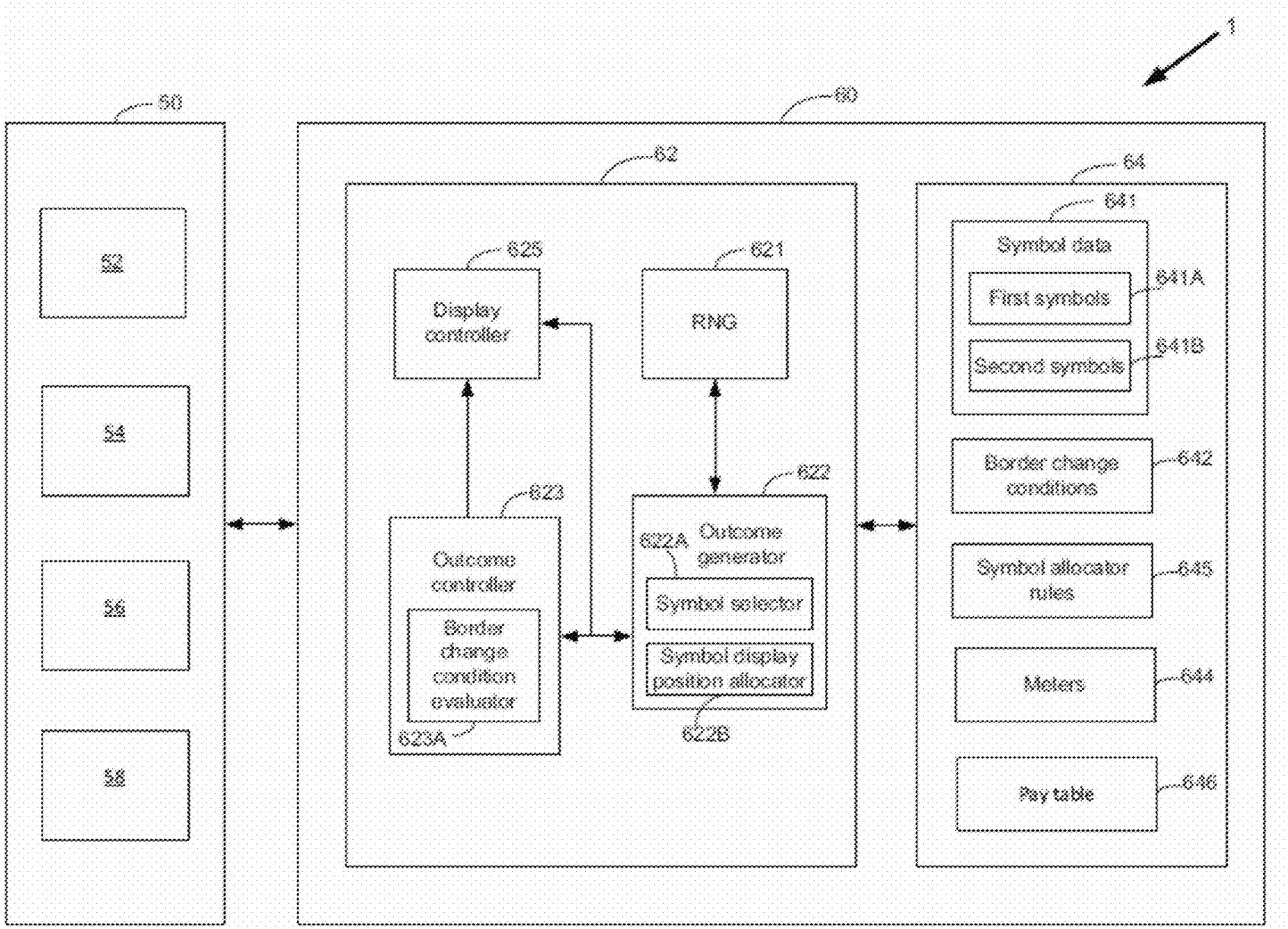
FIG. 6 is a further block diagram of a gaming system.

In FIG. 6, the processor 62 of game controller 60 of gaming system 1 is shown implementing a number of modules based on game program code 641 stored in memory 64. Persons skilled in the art will appreciate that various of the modules could be implemented in some other way, for example by a dedicated circuit.

These modules include display controller 625 which controls the display 54 to display the symbol evaluation area 810. In an embodiment, the symbol evaluation area 810 is a rectangular array of symbol display positions having a plurality of rows and a plurality of columns. In an embodiment, before the player initiates play of the game, symbols from a previous play of the game are displayed at the display positions.

Figure 8:
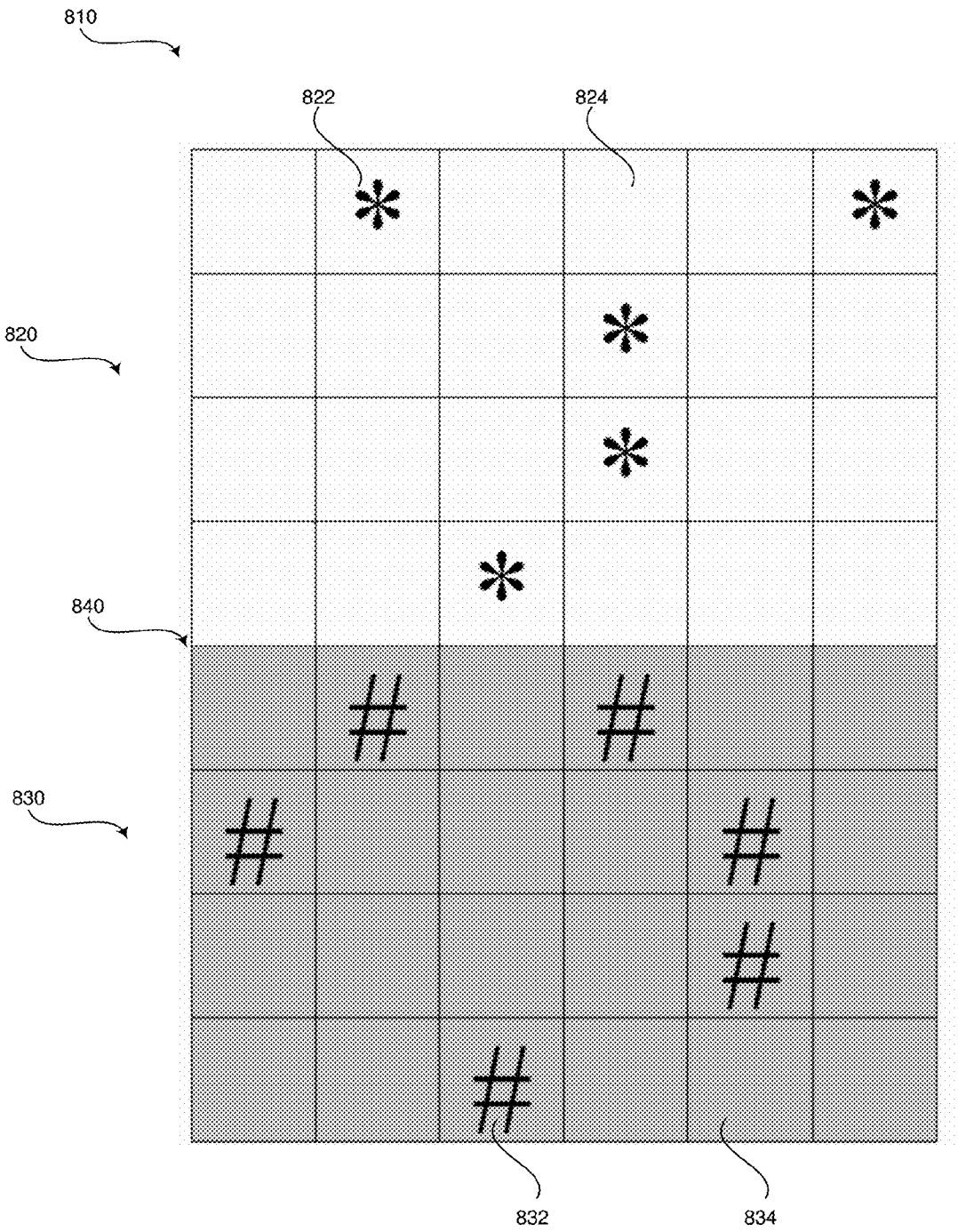
FIG. 8 shows an example of a display of a spinning reel game having a border divider separating two game instances each corresponding with one character.

As can be seen from FIG. 8, initially the two separate game instances 820, 830 are allocated evenly sized parts of the symbol evaluation area 810—i.e. the same number of symbol display positions. In the example of FIG. 8, each game instance 820, 830 is initially allocated four rows and six columns having twenty-four symbol display positions. The display positions in the first game instance 820 are populated with symbols selected from a first set of symbols comprising character symbols 822 and non-character symbols 824. The display positions in the second game instance 830 are populated with symbols selected from a second set of symbols comprising character symbols 832 and non-character symbols 834. The first and second game instances 820, 830 are separated by a border divider 840.

The outcome generator 622 operates in response to the player's operation of game play mechanism 56 to place a wager and/or initiate a play of the game and generates a game outcome which will then be evaluated by outcome evaluator 623.

In an embodiment, there are a number of stages to forming a game outcome. The first part of forming the game outcome is for a symbol selector 622A to select symbols from the first and second sets of symbols specified by symbol data 641 using random number generator 621 to form an initial game outcome. One example of generating a first game outcome is for the symbol selector 622A to select symbols from symbol data 641 in the form of a plurality of symbol sets corresponding to respective ones of a plurality of reels. The symbol sets specify a sequence of symbols for each reel such that the symbol selector 622A can select all of the symbols to be displayed for each reel by selecting a stopping position in the sequence. In the example shown in FIG. 8, in games where the border has not changed or is in a center position evenly dividing the first and second game instances 820, 830, four symbols of each of six reels are displayed for each of the game instances 820, 830.

In an embodiment, after the selected symbols are advised to the display controller 625 which causes them to be displayed on display 54 at the symbol display positions, a determination is made as to which character has won as defined by the border change conditions 642. In an embodiment, the determination comprises the border change condition determiner 623A of the outcome evaluator 623 determining whether a first character associated with the first game instance 820 or a second character associated with the second game instance 830 has won based on the border change conditions 642. In various embodiments, the border change conditions 642 specify a semi-random method for determining the winning character based at least in part on how many spins have occurred during the game and the number or reels each character controls. For example, a weighted table, such as the table illustrated in FIG. 11 and described below, may be applied to determine whether the first character or the second character has won.

Still referring to FIG. 6, upon the border change condition determiner 623A determining the winning character of the spin, the symbol display position allocator 622B carries out a border change corresponding with the determined winning character and updates the display position appearance based on symbol allocation rules 645. For example, by determining that the first character associated with the first game instance 820 has won, the symbol display position allocator 622B applies the symbol allocation rules 645 to move the border divider 840 to capture a row or column previously controlled by the second character associated with the second game instance 830. Moreover, the character symbols 832 and non-character symbols 834 in the captured row or column previously associated with the second game instance 830 are converted by the symbol display position allocator 622B applying the symbol allocation rules 645 to character symbols 822 and non-character symbols 824 associated with the first game instance 820.

FIG. 9 illustrates an example of the border divider 840 movement and display position appearance updates from the border divider position and display position appearance illustrated in FIG. 8, based on the determined winning character. Specifically, the first row of the second game instance 830 in FIG. 8 is converted to the last row of the first game instance 820 in FIG. 9 as the border divider 840 is moved down one row. Referring to FIG. 9, after the border divider change and the update to the display position appearance of the row captured by the first game instance 820, the first game instance 820 includes five rows and the second game instance 830 includes three rows. In various embodiments, the game continues until all rows are captured by one of the two characters.

The outcome controller 623 evaluates the total number of character symbols 822 and 832 displayed in the first game instance 820 and the second game instance 830 as specified in pay table 643. For example, in FIG. 9 seven "*" character symbols 822 and four "#" character symbols 832 are displayed for a total of eleven character symbols. The pay table 643 may specify applying a multiplier (e.g., 3 or any suitable multiplier) and the total number of character symbols 822, 832 multiplied by the multiplier is awarded to the win meter associated with the player and stored in meter data 644. In an embodiment, the multiplier may vary based on game conditions. For example, the multiplier may increase with each round in the game.

Figure 7:
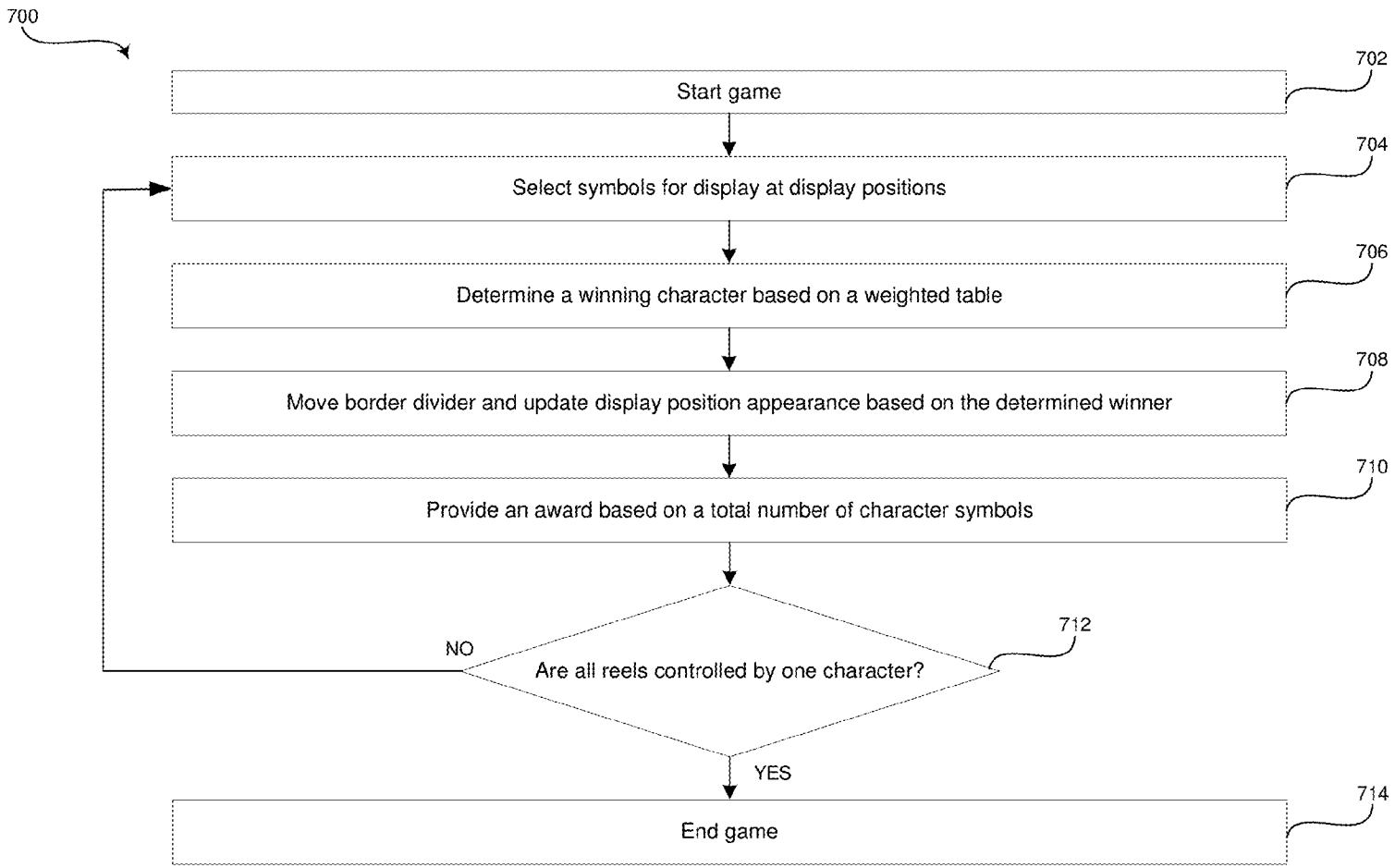
FIG. 7 is a flow chart of an embodiment.

FIG. 7 is a flow chart 700 illustrating exemplary steps 702-714 that may be utilized for providing a spinning reel game, in accordance with an embodiment of the invention. Referring to FIG. 7, there is shown a flow chart 700 comprising exemplary steps 702 through 714. Certain embodiments of the present invention may omit one or more of the steps, and/or perform the steps in a different order than the order listed, and/or combine certain of the steps discussed below. For example, some steps may not be performed in certain embodiments of the present invention. As a further example, certain steps may be performed in a different temporal order, including simultaneously, than listed below.

At step 702, the game is started by a processor 62 of a game controller 60 at a gaming system 1. For example, the game may be a stand alone game or a bonus game launched from a primary game, among other things. The game is a spinning reel game having a border divider 840 separating two game instances 820, 830 each corresponding with one character. The border divider 840 is moveable after each reel spin during the game based on a weighted table until all reels are controlled by one character. In an embodiment, an award is provided after each reel spin that corresponds with a number of displayed character symbols 822, 832. In an embodiment, the two game instances 820, 830 may be provided on one display 54 or multiple displays 54. The game may be associated with a theme. For example, FIG. 10 is a screenshot of the spinning reel game having a Game of Thrones theme where the first game instance 820 is associated with a first character (e.g., Jaime) and the second game instance 830 is associated with a second character (e.g., Brienne).

At step 704, the processor 62 of the game controller 60 at the gaming system 1 selects symbols 822, 824, 832, 834 for presentation at display positions of a display 54 after each spin in the game. For example, the game includes a symbol presentation area 810 having display positions corresponding with a first game instance 820 and a second game instance 830. The processor 62 may include an outcome generator 622 having a symbol selector 622A to select symbols from the first 822, 824 and second 832, 834 sets of symbols specified by symbol data 641 using random number generator 621 after each spin. The selected symbols from the first set of symbols 822, 824 are displayed in the first game instance 820 and the selected symbols from the second set of symbols 832, 834 are displayed in the second game instance 830. The first set of symbols corresponding with the first game instance 820 comprises character symbols 822 and non-character symbols 824. For example, referring again to FIG. 10, the character symbols 822 are images of Jaime and the non-character symbols 824 are black boxes.

The second set of symbols corresponding with the second game instance 830 comprises character symbols 832 and non-character symbols 834. For example, in FIG. 10 the character symbols 832 are images of Brienne and the non-character symbols 824 are white boxes.

At step 706, the processor 62 of the game controller 60 at the gaming system 1 determines a winning character based on a weighted table. For example, the processor 62 may comprise an outcome controller 623 having a border change condition evaluator 623A that determines which character has won as defined by border change conditions 642. In an embodiment, the determination comprises the border change condition determiner 623A of the outcome evaluator 623 determining whether a first character associated with the first game instance 820 or a second character associated with the second game instance 830 has won based on the border change conditions 642. In various embodiments, the border change conditions 642 specify a semi-random method for determining the winning character based at least in part on how many spins have occurred during the game and the number or reels each character controls. The border change conditions 642 may include, for example, the weighted table.

For example, FIG. 11 illustrates an exemplary weighted table that may be applied to determine whether the first character or the second character has won. Referring to FIG. 11, the table defines border divider positions 0 through 8 that correspond with first 820 and second 830 game instances having a total of eight rows (i.e., four rows per game instance 820, 830). The first character associated with the first game instance 820 wins when the border divider 840 is in position 8 and the second character associated with the second game instance 830 wins when the border divider 840 is in position 0. At the beginning of the game, the border divider 840 is positioned at the center position 4 that equally divides the first game instance 820 and the second game instance 830 into four rows. After the first spin, there is a 1-of-2 chance that the border divider 840 is moved up and a 1-of-2 chance that the border divider 840 is moved down. The border change condition evaluator 623A may apply the weighted table to determine the winning character after each spin using random number generator 621. The odds of the border divider 840 moving up or down may be different depending on the current border divider position and the current spin number. The weighted table may be configured to specify a minimum number of spins and a maximum number of spins in the game. In the exemplary weighted table of FIG. 11, the odds are set such that there are at least six spins and no more than twenty spins in the game.

Although FIG. 11 and the description above refers to border divider positions 0 through 8 corresponding with eight total rows, unless so claimed, the scope of various aspects of the present invention should not be limited to nine positions or that the border divider 840 separates rows. Additionally and/or alternatively the border divider 840 may be a vertical border divider separating columns of a first game instance and a second game instance. Moreover, the number of border divider positions may be greater than or less than nine positions by varying the number of rows (or columns) for each of the first 820 and second 830 game instances. Furthermore, although FIG. 11 and the description above refers to a minimum number of six spins and a maximum number of twenty spins in the game, unless so claimed, the scope of various aspects of the present invention should not be limited to between six and twenty spins and may be any suitable number and/or range of spins. Additionally, although FIG. 11 and the description above refers to exemplary odds at different border divider positions for different spin numbers, unless so claimed, the scope of various aspects of the present invention should not be limited to the exemplary odds illustrated in FIG. 11 and may be any suitable odds.

At step 708, the processor 62 of the game controller 60 at the gaming system moves the border divider 840 and updates the display position appearance based on the winner determined at step 706. For example, the processor 62 may comprise an outcome generator 622 having a symbol display position allocator 622B that carries out the border change corresponding with the determined winning character and updates the display position appearance based on symbol allocation rules 645. For example, by determining that the first character associated with the first game instance 820 has won, the symbol display position allocator 622B applies the symbol allocation rules 645 to move the border divider 840 to capture a row or column previously controlled by the second character associated with the second game instance 830. The symbol display position allocator 622B converts the character symbols 832 and non-character symbols 834 in the captured row or column previously associated with the second game instance 830 to character symbols 822 and non-character symbols 824 associated with the first game instance 820 based on the symbol allocation rules 645. For example, FIGS. 8 and 9 illustrate movement of the border divider 840 and conversion of the captured row from symbols 832, 834 associated with the second game instance 830 to symbols 822, 824 associated with the first game instance 820.

At step 710, the processor 62 of the game controller 60 at the gaming system 1 provides an award based on a total number of character symbols 822, 832 presented at display 52. For example, the processor 62 may comprise an outcome controller 623 configured to evaluate the total number of character symbols 822 and 832 displayed in the first game instance 820 and the second game instance 830 as specified in pay table 643. For example, in FIG. 9 seven "*" character symbols 822 and four "#" character symbols 832 are displayed for a total of eleven character symbols. As another example, in FIG. 10 seven "Jaime" symbols 822 and eight "Brienne" symbols 832 are presented at display 54 for a total of fifteen character symbols. The pay table 643 may specify applying a multiplier (e.g., 3 or any suitable multiplier) and the total number of character symbols 822, 832 multiplied by the multiplier is awarded to the win meter associated with the player and stored in meter data 644. In various embodiments, the multiplier is selected based on the round of gaming. For example, the multiplier may increase with each spin in the game.

At step 712, the processor 62 of the game controller 60 at the gaming system 1 determines whether all the reels are controlled by one character. For example, in FIG. 9, all of the reels are not controlled by one character. Instead, in FIG. 9 five rows are controlled by the character associated with the first game instance 820 and three rows are controlled by the character associated with the second game instance 830. If all reels are not controlled by one character as shown in FIG. 9, the method would return to step 704, the round or spin number would increase by one, and a new spin occurs resulting in the processor 62 of the gaming system 1 selecting symbols 822, 824, 832, 834 for presentation at display positions of the display 54. If all reels are controlled by one character, the method proceeds to step 714.

At step 714, the game is ended by the processor 62 of the game controller 60 at the gaming system 1. For example, the winning character may be displayed at the conclusion of the game. In an embodiment, if the game is a feature game, the processor 62 of the gaming system 1 may revert to the primary game at the conclusion of the feature game. Additionally and/or alternatively, the player(s) may cash out at the conclusion of the game.

Persons skilled in the art will appreciate that there are a number of alternative embodiments. Firstly, in the above described embodiment, the player plays both game instances. In other embodiments, game instances could be allocated to separate players in a competition between players. One of the players could be a "computer" player. Games between two players lend themselves to, for example, a tournament mode.

Further, while the above embodiment shows separate symbol sets being used to populate the two different areas, the symbols from the same symbol set could be used to populate the areas allocated to the two game instances.

Further, it will be appreciated that while the above embodiment has been described in relation to a neutral starting point between the two game instances, the game could start with one game instance having allocated to it more rows or columns than the other game instance.

In yet another embodiment, the border could run vertically. In one embodiment there could be five reels on one side of the border initially and five reels on the other side of the border. Changes to the border could result in the entirety of a reel being reallocated between the two game instances.

Aspects of the present invention provide an electronic method of gaming 700 in a gaming system 1, 10, 100 comprising a display 14, 54, 106 and a game controller 60, 101. The method 700 comprises displaying 702, 704, on the display 14, 54, 106, an evaluation area 810 comprising a plurality of columns of symbol display positions. The symbol display positions are divided between first 820 and second game instances 830 by a border divider 840 such that symbol display positions on a first side of the border divider 840 are allocated to the first game instance 820 and symbol display positions on a second side of the border divider 840 are allocated to the second game instance 830. The method 700 comprises selecting 704, by the game controller 60, 101, symbols 822, 824, 832, 834 for the first 820 and second 830 game instances and displaying the selected symbols 822, 824, 832, 834 on the display 14, 54, 106 in response to initiation of a round of gaming. The method 700 comprises determining 706, by the game controller 60, 101, a winning game instance associated with the round of gaming from the first game instance 820 and the second game instance 830. The winning game instance is determined based on a round number and a position of the border divider 840. The method 700 comprises moving 708, by the game controller 60, 101, the border divider 840 based on the determination of the winning game instance. The method 700 comprises determining 710, by the game controller 60, 101, an award based on symbols displayed at the symbol positions after the border divider 840 is moved.

In various embodiment, moving the border divider 840 results in one of a row or a column of symbols of a losing one of the first 820 or second 830 game instances being reallocated to the other of the first 820 or second 830 game instances that is the winning game instance. In certain embodiments, the method 700 comprises updating 708 a visual appearance of the one of the row or the column of the symbols of the losing one of the first 820 or second 830 game instances to correspond with a visual appearance of symbols for the winning game instance. In a representative embodiment, the symbols comprise first award symbols 822 and first non-award symbols 824 forming a first set of symbols associated with the first game instance 820. The symbols comprise second award symbols 832 and second non-award symbols 834 forming a second set of symbols associated with the second game instance 830. In various embodiments, the award is determined based on a total of the first award symbols 822 and the second award symbols 832. In certain embodiments, the award is based on applying a multiplier to the total of the first award symbols 822 and the second award symbols 832.

In a representative embodiment, the symbols for the first 820 and second 830 game instances are selected independently of one another. In various embodiments, the border divider 840 divides the columns of symbol display positions between each game instance 820, 830. In certain embodiments, the method 700 comprises executing computer program code. In a representative embodiment, the method 700 comprises storing the computer program code in a tangible computer readable medium 64, 103.

Certain embodiments provide an electronic game controller 60, 101 comprising a display controller 62, 102, 625 configured to control a display 14, 54, 106 of a gaming system 1, 10, 100 to display an evaluation area 810 comprising a plurality of columns of symbol display positions. The symbol display positions are divided between first 820 and second 830 game instances by a border divider 840 such that symbol display positions on a first side of the border divider 840 are allocated to the first game instance 820 and symbol display positions on a second side of the border divider 840 are allocated to the second game instance 830. The electronic game controller 60, 101 comprises a symbol selector 62, 102, 622A configured to select symbols 822, 824, 832, 834 for the first 820 and second 830 game instances such that the selected symbols are displayed on the display 14, 54, 106 in response to initiation of a round of gaming. The electronic game controller 60, 101 comprises a border change condition evaluator 62, 102, 623A configured to determine a winning game instance associated with the round of gaming from the first game instance 820 and the second game instance 830. The winning game instance is determined based on a round number and a position of the border divider 840. The electronic game controller 60, 101 comprises a symbol display position allocator 62, 102, 622B configured to move the border divider 840 based on the determination of the winning game instance. The electronic game controller 60, 101 comprises an outcome controller 62, 102, 623 configured to determine an award based on symbols displayed at the symbol positions after the border divider 840 is moved.

In a representative embodiment, the symbol display position allocator 62, 102, 622B is configured to move the border divider 840 by reallocating one of a row or a column of a losing one of the first 820 or second 830 game instances to the other of the first 820 or second 830 game instances that is the winning game instance. In various embodiments, the symbol display position allocator 62, 102, 622B is configured to update a visual appearance of the one of the row or the column of the symbols of the losing one of the first 820 or second 830 game instances to correspond with a visual appearance of symbols for the winning game instance. In certain embodiments, the symbols comprise first award symbols 822 and first non-award symbols 824 forming a first set of symbols associated with the first game instance 820. The symbols comprise second award symbols 832 and second non-award symbols 834 forming a second set of symbols associated with the second game instance 830. In a representative embodiment, the outcome controller 62, 102, 623 is configured to determine the award based on a total of the first award symbols 822 and the second award symbols 832.

In certain embodiments, the outcome controller 62, 102, 623 is configured to determine the award based on applying a multiplier to the total of the first award symbols 822 and the second award symbols 832. In various embodiments, the symbol selector 62, 102, 622A is configured to select the symbols for the first 820 and second 830 game instances independently of one another. In a representative embodiment, the border divider 840 divides the columns of symbol display positions between each game instance 820, 830.

Various embodiments provide a gaming system 1, 10, 100 comprising a display 14, 54, 106 and a game controller 60, 101. The game controller 60, 101 is configured to control the display 14, 54, 106 of the gaming system 1, 10, 100 to display an evaluation area 810 comprising a plurality of columns of symbol display positions. The symbol display positions are divided between first 820 and second 830 game instances by a border divider 840 such that symbol display positions on a first side of the border divider 840 are allocated to the first game instance 820 and symbol display positions on a second side of the border divider 840 are allocated to the second game instance 830. The game controller 60, 101 is configured to select symbols for the first 820 and second 830 game instances such that the selected symbols 822, 824, 832, 834 are displayed on the display 14, 54, 106 in response to initiation of a round of gaming. The game controller 60, 101 is configured to determine a winning game instance associated with the round of gaming from the first game instance 820 and the second game instance 830. The winning game instance is determined based on a round number and a position of the border divider 840. The game controller 60, 101 is configured to move the border divider 840 based on the determination of the winning game instance. The game controller 60, 101 is configured to determine an award based on symbols displayed at the symbol positions after the border divider 840 is moved.

An exemplary embodiment comprises a gaming system 1, 10, 100 comprising means for displaying an evaluation area 810 comprising a plurality of columns of symbol display positions. The symbol display positions are divided between first 820 and second 830 game instances by a border divider 840 such that symbol display positions on a first side of the border divider 840 are allocated to the first game instance 820 and symbol display positions on a second side of the border divider 840 are allocated to the second game instance 830. The gaming system 1, 10, 100 comprises means for selecting symbols for the first 820 and second 830 game instances and displaying the selected symbols 822, 824, 832, 834 on the display 14, 54, 106 in response to initiation of a round of gaming. The gaming system 1, 10, 100 comprises means for determining a winning game instance associated with the round of gaming from the first game instance 820 and the second game instance 830. The winning game instance is determined based on a round number and a position of the border divider 840. The gaming system 1, 10, 100 comprises means for moving the border divider 840 based on the determination of the winning game instance. The gaming system 1, 10, 100 comprises means for determining an award based on symbols displayed at the symbol positions after the border divider 840 is moved.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art will appreciate that program code provides a series of instructions executable by the processor.

It will be understood to persons skilled in the art of the invention that many modifications may be made without departing from the spirit and scope of the invention. In particular, it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An electronic method of gaming in a gaming system comprising: a display, a game controller having at least one processor and memory device configured to operate the gaming system, an acceptor and cashout device, wherein a credit input mechanism is configured to receive a physical item via the acceptor representing a monetary value to enable a player to input credits for establishing a credit balance, hardware meters configured to monitor the credit input having been provided by the credit input mechanism for establishing the credit balance, the credit balance being increasable and decreasable, and an output mechanism configured to cause a payout via the cashout device associated with the credit balance, the method comprising:

displaying, on the display, an evaluation area comprising a plurality of columns of symbol display positions, wherein the symbol display positions are divided between first and second game instances by a border divider such that symbol display positions on a first side of the border divider are allocated to the first game instance and symbol display positions on a second side of the border divider are allocated to the second game instance;

selecting, by the game controller, symbols for the first and second game instances and displaying the selected symbols on the display in response to initiation of a round of gaming;

determining, by the game controller, a winning game instance associated with the round of gaming from the first game instance and the second game instance, wherein the winning game instance is determined based on a round number and a position of the border divider;

moving, by the game controller, the border divider based on the determination of the winning game instance; and determining, by the game controller, an award based on symbols displayed at the symbol positions after the border divider is moved.

2. The electronic method of claim 1, wherein moving the border divider results in one of a row or a column of symbols of a losing one of the first and second game instances being reallocated to the other of the first or second game instances that is the winning game instance.

3. The electronic method of claim 2, comprising updating a visual appearance of the one of the row or the column of the symbols of the losing one of the first or second game instances to correspond with a visual appearance of symbols for the winning game instance.

4. The electronic method of claim 1, wherein the symbols comprise:

first award symbols and first non-award symbols forming a first set of symbols associated with the first game instance, and second award symbols and second non-award symbols forming a second set of symbols associated with the second game instance.

5. The electronic method of claim 4, wherein the award is determined based on a total of the first award symbols and the second award symbols.

6. The electronic method of claim 5, wherein the award is based on applying a multiplier to the total of the first award symbols and the second award symbols.

7. The electronic method of claim 4, wherein the symbols for the first and second game instances are selected independently of one another.

8. The electronic method of claim 1, wherein the border divider divides the columns of symbol display positions between each game instance.

9. The electronic method of claim 1, comprising executing computer program code.

10. The electronic method of claim 9, comprising storing the computer program code in a tangible computer readable medium.

11. An electronic game controller comprising:

at least one processor and memory device configured to operate a gaming machine, wherein the gaming machine comprises an acceptor and cashout device, wherein a credit input mechanism operable by a player is configured to receive a physical item via the acceptor representing a monetary value to enable a player to input credits for establishing a credit balance, hardware meters configured to monitor the credit input having been provided by the credit input mechanism for establishing the credit balance, the credit balance being increasable and decreasable, and an output mechanism configured to cause a payout via the cashout device associated with the credit balance;

a display controller configured to control a display of a gaming system to display an evaluation area comprising a plurality of columns of symbol display positions, wherein the symbol display positions are divided between first and second game instances by a border divider such that symbol display positions on a first side of the border divider are allocated to the first game instance and symbol display positions on a second side of the border divider are allocated to the second game instance;

a symbol selector configured to select symbols for the first and second game instances such that the selected symbols are displayed on the display in response to initiation of a round of gaming;

a border change condition evaluator configured to determine a winning game instance associated with the round of gaming from the first game instance and the second game instance, wherein the winning game instance is determined based on a round number and a position of the border divider;

a symbol display position allocator configured to move the border divider based on the determination of the winning game instance; and an outcome controller configured to determine an award based on symbols displayed at the symbol positions after the border divider is moved.

12. The electronic game controller of claim 11, wherein the symbol display position allocator is configured to move the border divider by reallocating one of a row or a column of a losing one of the first or second game instances to the other of the first or second game instances that is the winning game instance.

13. The electronic game controller of claim 12, wherein the symbol display position allocator is configured to update a visual appearance of the one of the row or the column of the symbols of the losing one of the first or second game instances to correspond with a visual appearance of symbols for the winning game instance.

14. The electronic game controller of claim 11, wherein the symbols comprise:

first award symbols and first non-award symbols forming a first set of symbols associated with the first game instance, and second award symbols and second non-award symbols forming a second set of symbols associated with the second game instance.

15. The electronic game controller of claim 14, wherein the outcome controller is configured to determine the award based on a total of the first award symbols and the second award symbols.

16. The electronic game controller of claim 15, wherein the outcome controller is configured to determine the award based on applying a multiplier to the total of the first award symbols and the second award symbols.

17. The electronic game controller of claim 14, wherein the symbol selector is configured to select the symbols for the first and second game instances independently of one another.

18. The electronic game controller of claim 11, wherein the border divider divides the columns of symbol display positions between each game instance.

19. A gaming system comprising:

an acceptor and cashout device, wherein a credit input mechanism is configured to receive a physical item via the acceptor representing a monetary value to enable a player to input credits for establishing a credit balance;

hardware meters configured to monitor the credit input having been provided by the credit input mechanism for establishing the credit balance, the credit balance being increasable and decreasable;

an output mechanism configured to cause a payout via the cashout device associated with the credit balance;

a display;

a game controller having at least one processor and memory device configured to operate the gaming system, the game controller configured to:

control the display of the gaming system to display an evaluation area comprising a plurality of columns of symbol display positions, wherein the symbol display positions are divided between first and second game instances by a border divider such that symbol display positions on a first side of the border divider are allocated to the first game instance and symbol display positions on a second side of the border divider are allocated to the second game instance;

select symbols for the first and second game instances such that the selected symbols are displayed on the display in response to initiation of a round of gaming;

determine a winning game instance associated with the round of gaming from the first game instance and the second game instance, wherein the winning game instance is determined based on a round number and a position of the border divider;

move the border divider based on the determination of the winning game instance; and determine an award based on symbols displayed at the symbol positions after the border divider is moved.

20. A gaming system comprising:

means for receiving a physical item representing a monetary value to enable a player to input credits for establishing a credit balance;

means for monitoring the credit input for establishing the credit balance, the credit balance being increasable and decreasable;

means for causing a payout associated with the credit balance;

means for displaying an evaluation area comprising a plurality of columns of symbol display positions, wherein the symbol display positions are divided between first and second game instances by a border divider such that symbol display positions on a first side of the border divider are allocated to the first game instance and symbol display positions on a second side of the border divider are allocated to the second game instance;

means for selecting symbols for the first and second game instances and displaying the selected symbols on the display in response to initiation of a round of gaming;

means for determining a winning game instance associated with the round of gaming from the first game instance and the second game instance, wherein the winning game instance is determined based on a round number and a position of the border divider;

means for moving the border divider based on the determination of the winning game instance; and means for determining an award based on symbols displayed at the symbol positions after the border divider is moved.

* * * * *